US005083441A

United States Patent [19]

Zeitlin

[11] Patent Number: 5,083,441

[45] Date of Patent: Jan. 28, 1992

[54] COMESTIBLE COOLING DEVICE

[76] Inventor: Eric S. Zeitlin, 3059 Grand Ave., Baldwin, N.Y. 11510

[21] Appl. No.: 602,406

[22] Filed: Oct. 7, 1990

Related U.S. Application Data

[62] Division of Ser. No. 486,812, Mar. 1, 1990.

[51] Int. Cl.[5] ..... F25D 3/00

[52] U.S. Cl. ..... 62/293; 62/299; 30/123

[58] Field of Search ..... 62/293, 299, 237; 30/123, 140, 141

[56] References Cited

U.S. PATENT DOCUMENTS

| | | | |
|---|---|---|---|
| 2,805,554 | 9/1957 | Schachtsiek | 62/293 |
| 2,900,808 | 8/1959 | Wang | 62/293 |
| 3,077,085 | 2/1963 | Johnston et al. | 62/293 |
| 3,647,323 | 2/1972 | Thomas | 417/234 |
| 4,044,750 | 7/1977 | Zeigler | 126/25 B |
| 4,190,034 | 2/1980 | Wonisch | 126/25 B |
| 4,237,697 | 12/1980 | Cherbland | 62/293 |

*Primary Examiner*—Albert J. Makay
*Assistant Examiner*—John Sollecito

[57] ABSTRACT

A manually actuated comestible cooling device (Z) that may be removably secured to a food or liquid holding utensil (F), container, or the like, which will generate a draft in a desired direction that is of material assistance in fanning and cooling the food or liquid held by the utensil (F), container, or other food or liquid holding device.

16 Claims, 13 Drawing Sheets

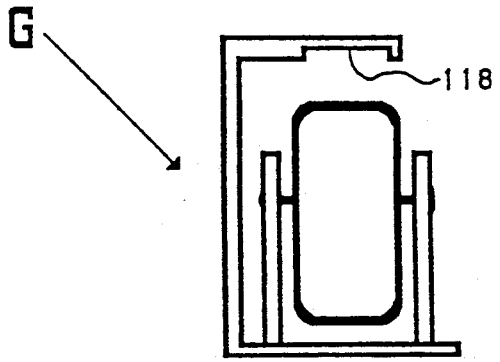
FIG. 9
FIG. 10
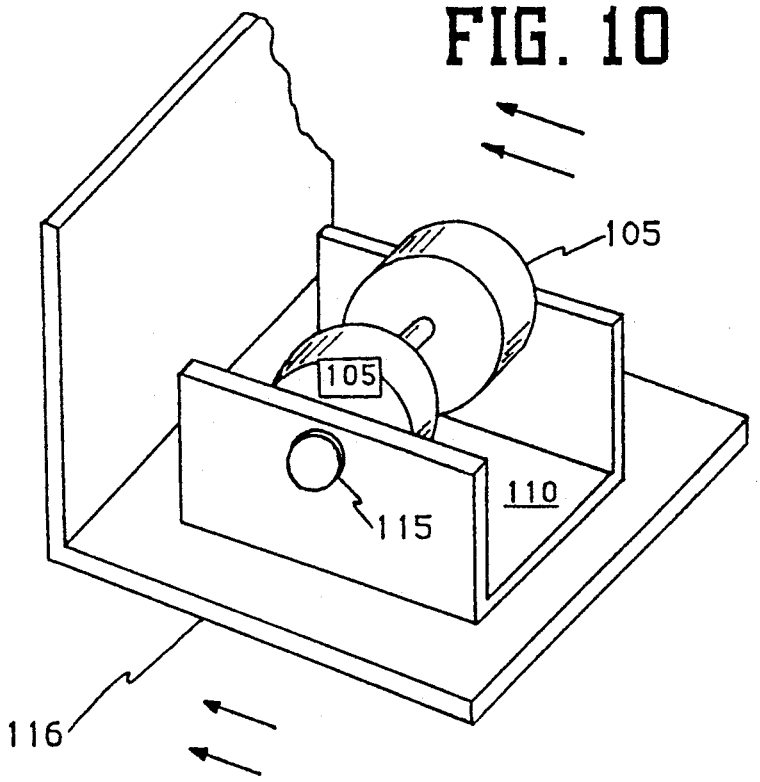

FIG. 11
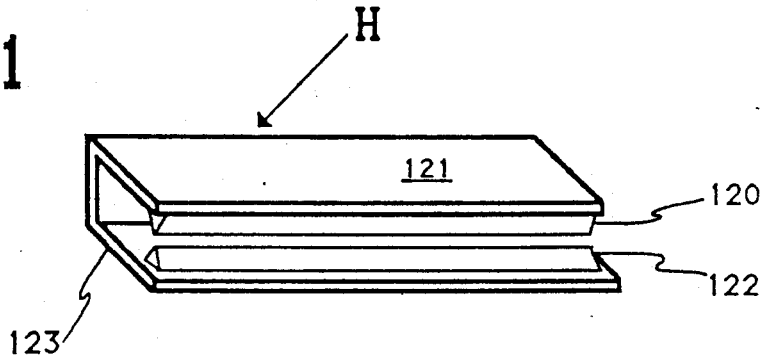
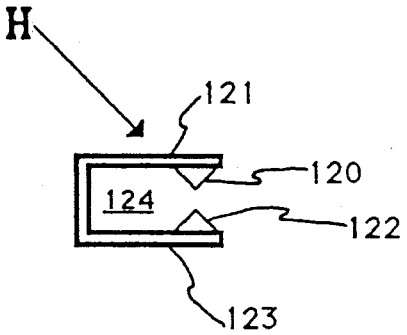
FIG. 12
FIG. 13
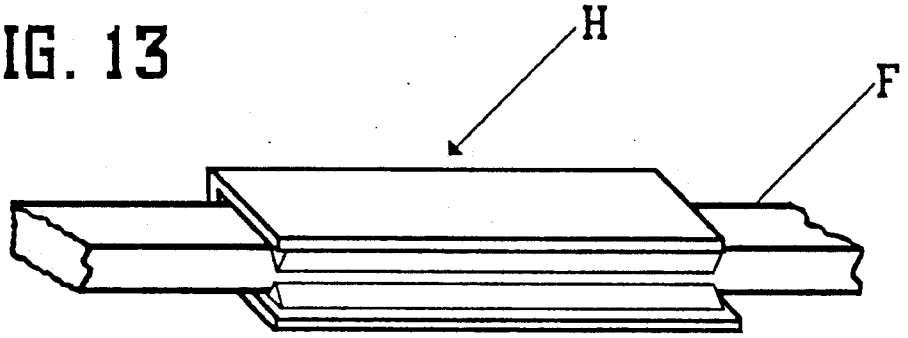

FIG. 16
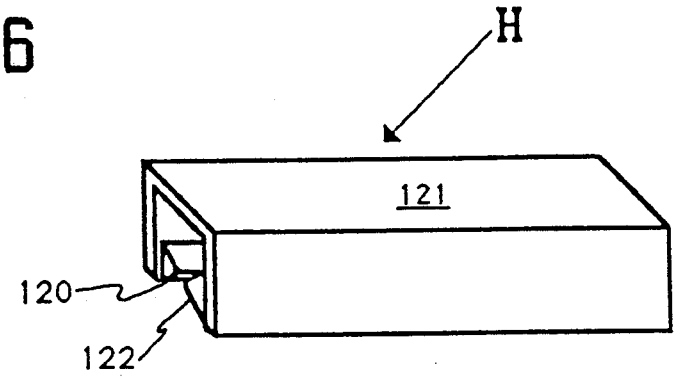
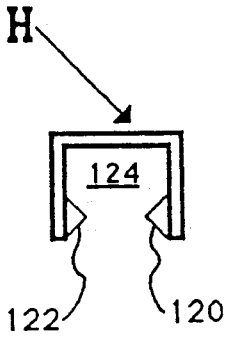
FIG. 17
FIG. 18
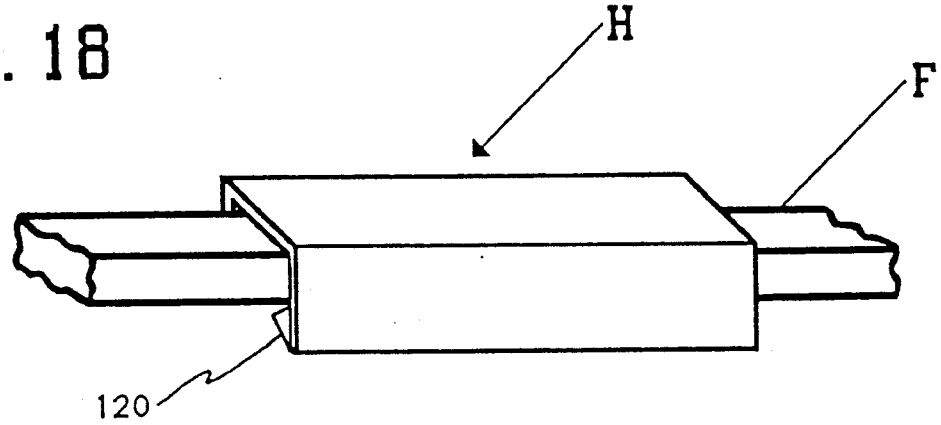

FIG. 19
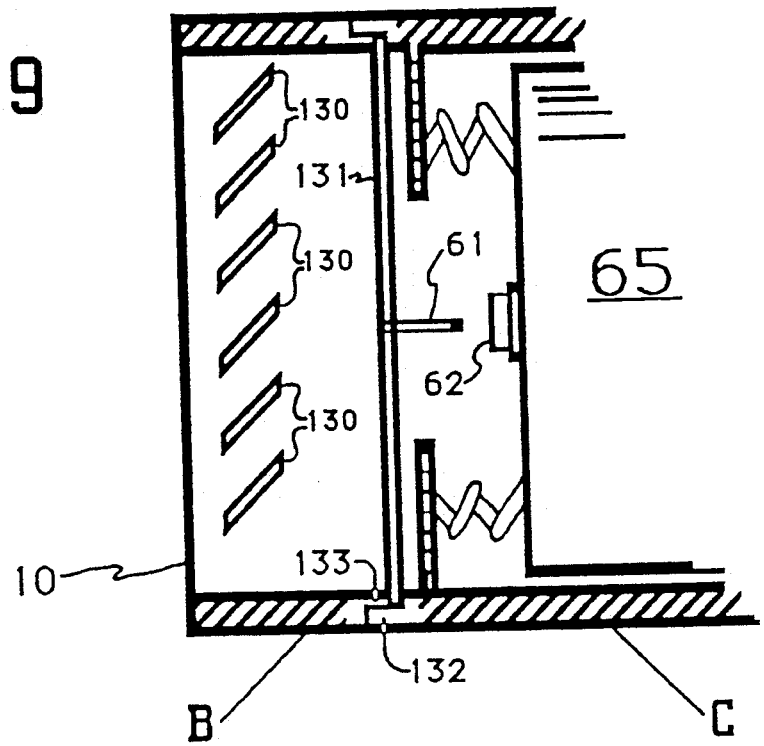
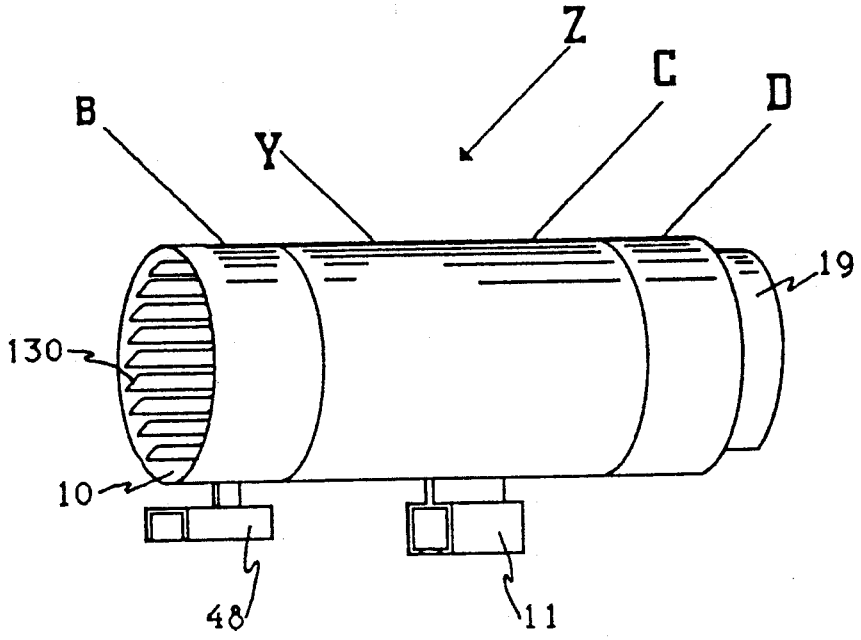
FIG. 20

COMESTIBLE COOLING DEVICE

This is a divisional application of Patent Pending Ser. No. 07/486,812, filed Mar. 1, 1990 by Eric S. Zeitlin, entitled "Food and Liquid Fanning Device".

BACKGROUND

1. Field of the Invention

This invention relates to fanning and cooling devices, more specifically to a device used to fan and cool comestibles (foods and edible liquids).

2. Description of Prior Art

Heretofore, there has been no quick, easy, efficient and interesting way to cool hot foods or liquids conveniently while, for example, sitting at the dinner table after the food or liquid (i.e.; soup, spaghetti, coffee) has already been prepared and served.

Until now efforts to cool food or liquid that is too hot for the eater to eat has been limited to either putting ice in/on the hot food or liquid, blowing breath on the hot food or liquid by the eater, or just waiting until the hot food or liquid cools down sufficiently to enable comfortable ingestion.

These methods have many disadvantages which the present invention avoids:

1—Putting ice on/in the hot food or liquid causes food to get "soggy" and liquid to get "watered down".

2—Just waiting is time consuming and frustrating if the eater is either impatient, hungry, or in a rush, such frustration possibly leading to bad moods, strained relationships, fits of anger or high blood pressure and it's related symptoms (i.e.; strokes or heart attacks).

3—Blowing breath on the hot food or liquid by the eater, probably the most common method used by eaters, contains such disadvantages as: a—the stream of breath is intermittent due to the limited capacity of human lungs. b—the stream of breath is not always accurate, sometimes missing the hot food or liquid altogether, thus providing an inefficient means of cooling and a less-than-optimal method of cooling given the amount of breath blown. c—the eater may suffer adverse health effects from blowing his breath, such as dizziness, nausea, or feinting resulting from hyperventilation or hypoventilation. d—because of reasons (a) and (b) discussed above, cooling of hot food or liquid takes longer than perhaps the eater wants to wait before ingesting his meal, leading to frustration and it's ill-effects discussed above. e—if the eater's breath is either misdirected or too forceful, the hot food or liquid being blown on can easily be blown off/out of it's holding device (i.e.; fork, spoon, bowl, cup, etc.) which can result in wasted food and liquids, leading to a further decreased world food supply and resulting starvation of the poorer peoples on earth as well as the decreased economic well being of the eater due to his own increased food costs. Furthermore, hot food or liquid that is blown off/out of it's holder can be dangerous, leading to possible injuries such as scalding, burning, or injuries resulting from the fear of getting burned or scalded such as jumping incorrectly from ones chair or pulling a muscle from quick, jerky movements resulting from trying to withdraw ones body from the direction of the moving/flying hot food or liquid which has been blown off/out of it's holder.

4—Present cutlery and other food and liquid holding devices are non-novel, increasing boredom while eating, resulting in a possibly less-than-exciting eating experience, and possible overeating by the eater due to the eater being bored.

The prior art contains many fanning devices, but none of these are made specifically for the fanning of food and liquids as the present invention is, nor do any of these prior art patents make any reference to their being used to that extent. Further, none of the prior art patents are designed for the same ease of use or towards simple, one-handed use as the present invention is. Additionally, none of the prior art patents contain the resilient "on" and "off" switch of the present invention which adds to ease of use. Neither do any mention that they be used as food or liquid cooling devices.

A search of the preliminary class and subclass 222/402.1 (given in the parent application "Food and Liquid Fanning Device" patent pending 07/486,812 to the device presently being applied for) reveals no similar prior art using compressed air or the like. However, two examples of fanning devices are Thomas' "Battery Operated Fanning Device", U.S. Pat. No. 3,647,323 and Zeigler's "Barbecue Blower" U.S. Pat. No. 4,044,750, both of which are designed to fan a fire or charcoal. Neither make any mention of being used to fan food or liquid nor do either mention that they may be modified to do so, showing that the present invention and it's uses were unobvious to those skilled in the art. The present invention further distinguishes itself from these examples of the closest prior art in many other ways; for example, the resilient "on" and "off" switch of the present invention is easier to use than the on and off switches of the prior art in that it allows one-handed, even one fingered (the thumb) operation, whereas the prior art's switches are more complicated to switch on and off, and if used in the context or situation of the present invention would be likely to cause spillage or droppage of the food or liquid being held by the cutlery or similar holding device, as well as create a difficulty of use that might deter a potential user.

Further, the present invention is less obtrusive, because of it's compact cylindrical shape, than the prior art, and thus better suited for the situation that the present invention is designed for, namely the fanning and cooling of foods and liquids.

The Inventor contends that because of these and other differences which will become obvious upon further inspection of the present invention, the present invention thus distinguishes itself in it's novelty over the prior art.

OBJECTS AND ADVANTAGES

Accordingly, several objects and advantages of the present invention are:

1—to supply a compact device of simple mechanical structure, that is removably or permanently situated on a holder of food or liquids or other such similar devices, so that the unit, when activated, will blow a stream of air which can be directed onto, over, or around the food or liquid being held by the holder.

2—provide a food and liquid fanning device which will bring more safety to the eating of hot foods and liquids by preventing such conditions as dizziness, nausea or feinting resulting from hyperventilation or hypoventilation, or other conditions resulting from unnatural breathing because of blowing breath on foods or liquids.

3—to provide a food and liquid fanning device which will add additional safety to the eating of hot foods and liquids by helping to prevent burns and scalding to the eater, caused by the ingestion of insufficiently cooled food or liquid (i.e.; a burnt tongue or throat) due to the eater using such inefficient cooling methods as described above.

4—to provide a food and liquid fanning device which will add additional safety to the eating of hot foods and liquids by helping to prevent burns and scalding to the eater due to falling hot food or liquid which may be blown off/out of it's holder due to a misdirected or too forceful stream of breath, as well as pulled muscles or the like due to the same situation.

5—to provide a food and liquid fanning device which will add additional safety to the eating of hot foods and liquids by helping to eliminate some of the frustration and it's resulting maladies from the eating of hot foods and liquids, as previously discussed, by providing a faster, more efficient way of cooling such hot foods or liquids than the present methods of cooling discussed above.

6—to provide a more enjoyable eating experience to an eater by preventing the burning of his taste buds from ingesting insufficiently cooled food or liquids, hence enabling the eater to taste his food or liquids fully.

7—to help protect the economic well being of an eater by helping to prevent unnecessary spillage or droppage of food or liquid due to a misdirected or too strong stream of breath, thus helping to keep his food costs as low as possible.

8—to help prevent the starvation of the poorer peoples of the earth by helping to prevent unnecessary spillage or droppage of food or liquid due to a misdirected or too strong stream of breath, thus helping to make sure no food or liquid is unnecessarily wasted.

9—to provide a food and liquid fanning device which helps reduce any additional need for cleaning tables, chairs, floors, and other surfaces of the dining area by helping to prevent unnecessary spillage or droppage of food or liquid due to a misdirected or too strong stream of breath onto any such dining area surfaces. This would also serve to reduce the amount of pollutants being disposed of by reducing the use of household cleaners, paper towels, rags, etc. because less cleaning will be required from spilled food and liquids.

10—to provide a food and liquid fanning device which will provide faster means of cooling foods and liquids through it's constant and more accurately directed stream of air which may be directed at or towards the food or liquid to be cooled.

11—to provide a food and liquid fanning device which is easy to use because of it's ability to be easily used with only one hand and at the simple push of a button.

12—to provide a more interesting food and liquid fanning device which will bring novelty to present food and liquid cooling methods. The present invention, especially if colored, painted, or otherwise made to be further pleasing to the eye, will help eliminate boredom of the user while eating, and thus will help extinguish boredom related symptoms such as overeating, feelings of depression, or fighting with ones dining companions.

13—to provide a food and liquid fanning device which will further help the user's human relationships by letting him talk with his dining companions if he so desires instead of having to use his breath to blow on his food or liquid.

14—to provide a food and liquid fanning device which will even further help the user's human relationships by helping to eliminate any potentially embarrassing situations to the user such as food or liquid being blown off/out of it's holder as previously discussed and onto the user or the user's dining companions.

15—to provide a food and liquid fanning device which will provide a more reliable cooling means than the current methods, as long as the present invention's gas supply is still existent, since, for example, ice may melt or an eater may be out of breath, coughing, sneezing, or otherwise unable to blow breath on his food or liquid.

16—to provide a food and liquid fanning device which will provide a means of cooling food and liquids that is ecologically safe to the earth's atmosphere; contrasted to an eater simply blowing breath on his food or liquids, where the eater, since he is exhaling more than when he is not blowing breath onto his food or liquid, is thus putting more carbon dioxide, a major atmospheric pollutant which may contribute to global warming or the "greenhouse effect", into the atmosphere than if he was using the present invention, which emits no more carbon dioxide than is already in the atmosphere, if compressed air is used.

17—to provide a food and liquid fanning device of greater accuracy and precision of cooling means than present cooling methods by providing an "on" and "off" button that can be instantly turned on or off by the user, as well as a constant stream of precisely directed air onto, over or around the food or liquid being cooled.

18—to provide a food and liquid fanning device which will be easily saleable because of it's small size, ease of use, and universal need for such a device, as well as easy market penetration because of the nonexistence of similar devices in the present marketplace.

19—to provide a food and liquid fanning device which will provide excitement to both neophiles and laypersons alike through the present invention's newness and novelty.

20—to provide a food and liquid fanning device which will have a long product life cycle, since there will be a need for the present invention as long as there is a need to cool foods and liquids.

21—to provide a food and liquid fanning device which will help save energy by precluding the need to reheat foods or liquids that have overcooled because of the inaccuracy of present cooling methods (i.e.; waiting too long for food or liquid to cool).

22—to provide a food and liquid fanning device which will not have to be modified depending on the "handedness" of the user; the food and liquid fanning device will work just as well for a user who is left-handed as one who is right-handed without having to modify the device.

23—to provide a food and liquid fanning device which will be smaller than those in the prior art and less obtrusive, thus suiting the present invention to being attached to a food or liquid holding device, such as a spoon, without the present invention causing substantial weight to be added onto the spoon being held and also not causing inconvenience to the user because of any obtrusiveness of the device.

24—to provide a food and liquid fanning device which will be more stable when placed on a food or liquid holding device (i.e.; a spoon) by the inclusion of a stabilizer on the Food and Liquid Fanning Device.

Still further objects and advantages will become apparent from a consideration of the ensuring description and drawings.

DRAWING FIGURES

FIG. 9 shows a frontal view of the slide-on holding device (G).

FIG. 10 shows a perspective view of a ramification of the slide-on holding device (G).

FIG. 11 shows a perspective view of the snap-in holding device (H).

FIG. 12 shows a frontal view of the snap-in holding device (H).

FIG. 13 shows a perspective view of the snap-in holding device (H) with spoon (F) inserted therein showing how the snap-in holding device (H) is meant to be used.

FIG. 16 shows a perspective view of a further ramification of the snap-in holding device (H).

FIG. 17 shows a frontal view of the snap-in holding device (H) shown in FIG. 16.

FIG. 18 shows a perspective view of a ramification of the snap-in holding device (H) shown in FIG. 16 with spoon (F) inserted therein, showing how this ramification of the snap-in holding device (H) is meant to be used.

FIG. 19 shows a fragmentary view of the front of FIG. 2 with horizontal fins (130), given in order to show that part of the Comestible Cooling Device (Z) with this ramification in more detail.

FIG. 20 shows a perspective view of the Comestible Cooling Device (Z) with fins (130).

REFERENCE NUMERALS IN DRAWINGS

Figure 1:
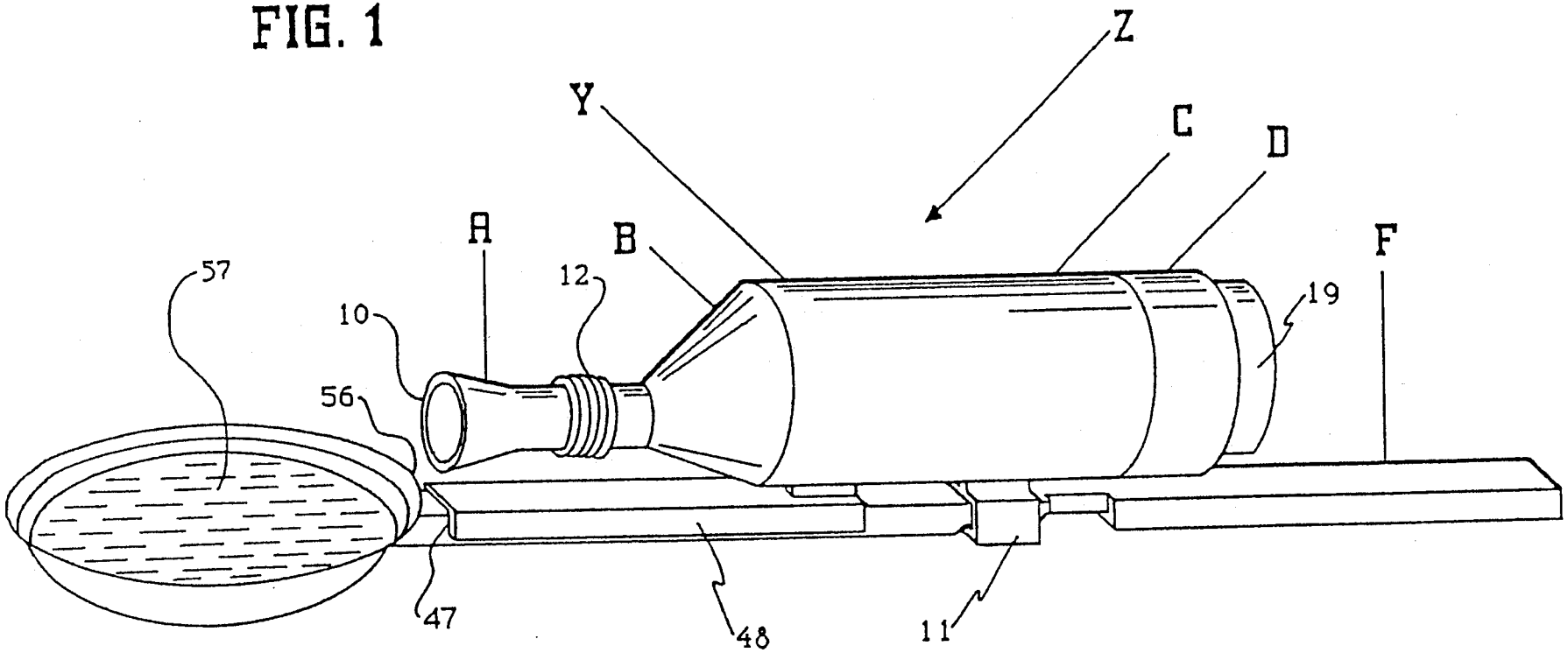
FIG. 1 is a perspective view of a Comestible Cooling Device (Z) attached to a spoon (F).

A—forwardly disposed housing part
B—first intermediate housing part
C—second intermediate housing part
D—back end housing part
E—longitudinal shaft assembly
F—cutlery; here a spoon
G—slide-on holding device
H—snap-in holding device Y—entire housing of the Comestible Cooling Device
Z—The entire Comestible Cooling Device
10—opening at front of housing part (A)
11—clip-on attaching unit
12—flexible connecting material between housing parts (A) and (B)
19—"on" and "off" switch
20—column on the inside of switch (19)
22—wall in housing part (D)
23, **23*a*, 23*b*, 23*c***—commercially available springs
27—tongue of housing part (D)
28—rearward end of housing part (C)
30 and **30*a***—notches on spoon (F)
34—air passage
37, **37*a*, 37*b*, and 37*c*—openings for insertion of springs (23, 23*a*, 23*b*, and 23*c***), respectively
38—switch extension
39 and **39*a*—protrusions on switch (19**)
47—front end of stabilizer (48)
48—stabilizer
49—sloping incline on spoon (F)
54—circular hole in the rear wall of housing part (D) which facilitates the insertion of switch (19) into part (D)
56— back end of liquid-holding part of spoon (F)
57— liquid held by spoon (F)
60— commerically available springs
61— thin extension/gas container opener
62— opening of gas container
63— wall inside housing part B
65— gas container
100— fastener
101— hole for insertion of fastener (100)
102— second hole for insertion of fastener (100)
103— hole in rubber wheel for insertion of fastener (100)
104— wheel holder
105— rubber wheel
106— outer surface of wheel (105)
107— hole in center of wheel (105)
108— cavity in wheel holder (104) for insertion of wheel (105)
109— back wall of wheel holder (104)
110— bottom of wheel holder (104)
115— head of fastener (100)
116— slide-on holding device (G) holder
117— top part of slide-on holding device (G) holder (116)
118— groove in underside of (117)
120— long "tooth" on underside of top part (121) of snap-in holding device (H)
121— top part of snap-in holding device (H)
122— long "tooth" on upper surface of bottom part (123) of snap-in holding device (H)
123— bottom part of snap-in holding device (H)
124— cavity formed in snap-in holding device (H) for insertion of cutlery (F)
**121*a***— extension of top part of variation of snap-in holding device (H)
125— fastener for (121) and (**121*a***)
126— hole in (**121*a*) for insertion of fastener (125**)
127— hole in (121) for insertion of fastener (125)
130— fins for regulating the direction of the outflowing air 131— transverse spider
132— recess of part (C)
133— tongue of housing part (B)

DESCRIPTION-FIGS. 1 TO 5

A typical embodiment of the Comestible Cooling Device (Z), as illustrated in the drawings, includes an elongate housing (Y) formed by housing parts (A, B, C, D) that has at least one first open end (10) and an internal cavity for the insertion of a gas-filled container (65) therein. The Comestible Cooling Device (Z) uses compressed air or other gas to provide a draft onto food or liquid held by a food or liquid holding device. Housing (Y) is made to facilitate the insertion of a container of compressed gas (65), with opening for the release of said gas (62), which is held in place by housing part (D) after part (D) is "screwed into" housing part (C), as described below.

The housing (Y) is preferably molded from a suitable polymerized resin, although any sturdy, lightweight material would be appropriate. Housing (Y) may be formed either as a whole integral unit or from multiple parts as shown here in the preferred embodiment.

Figure 3:
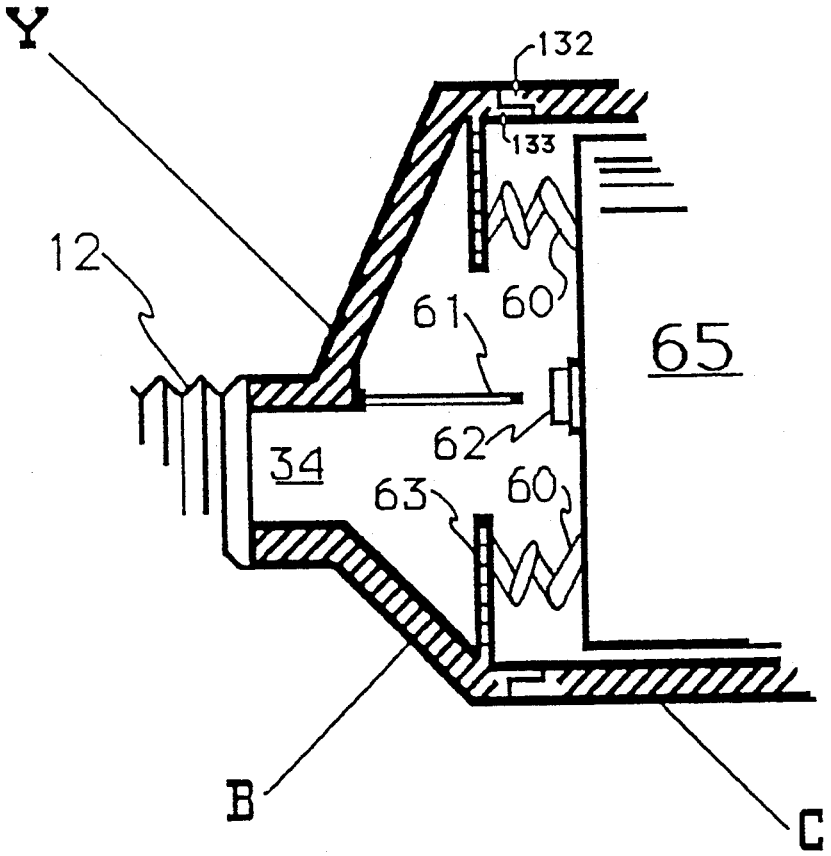
FIG. 3 is a fragmentary view of the front of FIG. 2, given in order to show that part of the Comestible Cooling Device (Z) in more detail.

FIG. 3 shows the forward section of the housing, part (B), having at it's second end a tongue (133) defined therein. Housing part (C) is also shown to have at it's first end a recess (132) which extends and engages the tongue (133) of housing part (B). Housing part (B) and (C) may be temporarily or permanently secured to each other by conventional means such as glue, adhesive, or the like.

Figure 5:
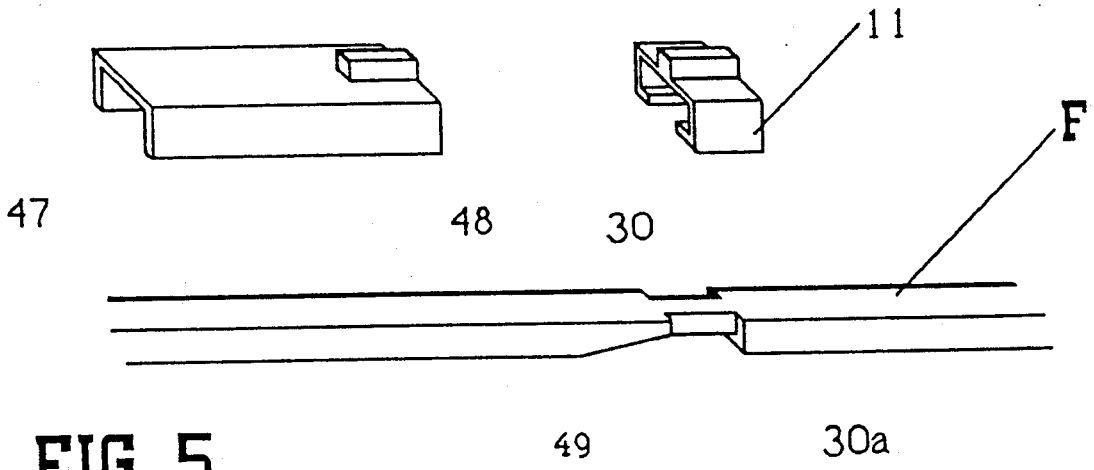
FIG. 5 shows a fragmentary perspective view of the clip-on attaching unit (11) and spoon (F) before attachment of the former to the latter, showing in detail the means of attachment. Also shown in the same context is the stabilizer bar (48).

FIG. 1 shows how the Comestible Cooling Device (Z) may be removably supported on a food or liquid holding utensil, shown in the preferred embodiment as a specially designed spoon (F). A means for securing Comestible Cooling Device (Z) to spoon (F) is shown as a downwardlyextending clip-on unit (11) which may be designed as part of housing (Y) or developed separately and secured to Comestible Cooling Device (Z) by conventional securing means. Housing (Y) may be secured temporarily (or permanently if desired) to spoon (F) by inserting the clip-on unit (11) into the notches (30 and 30*a*) located on spoon (F) and subsequently pushing the housing (Y) and clip-on unit (11) forward along upwardly sloping incline (49) on spoon (F), thus creating a tight "grip" between the clip-on unit (11) and spoon (F), as shown in FIG. 5. Comestible Cooling Device (Z) is thus held in place on spoon (F). A multitude of conventional attaching means, such as clamps, glues, adhesives, magnets, and the like may also be used to secure housing (Y) to spoon (F), but a non-permanent attaching means is preferred so that cleaning of the utensil or container is easily facilitated once the Comestible Cooling Device (Z) is removed from it. Additionally, other food or liquid holding devices may be used in place of spoon (F), such as forks, knives, other serving utensils, cups, mugs, bowls, glasses, and the like.

FIGS. 1, 5, and 20 show a stabilizer (48) located on the bottom of housing (Y) in front of clip-on unit (11). The purpose of the stabilizer is to help prevent the Comestible Cooling Device (Z) from moving when it is attached to spoon (F) or other food or liquid holding device. Stabilizer (48) also provides stability to the Comestible Cooling Device (Z) while it is attached to a food or liquid holding device. Additionally, stabilizer (48) can serve to keep the Comestible Cooling Device (Z) from moving forward while attached to a food or liquid holding device such as a spoon (F). This is accomplished as a result of the front end (47) of the stabilizer being abutted against the back end of the food or liquid holding device (56) when the Comestible Cooling Device (Z) is pushed forward until this occurs.

Figure 2:
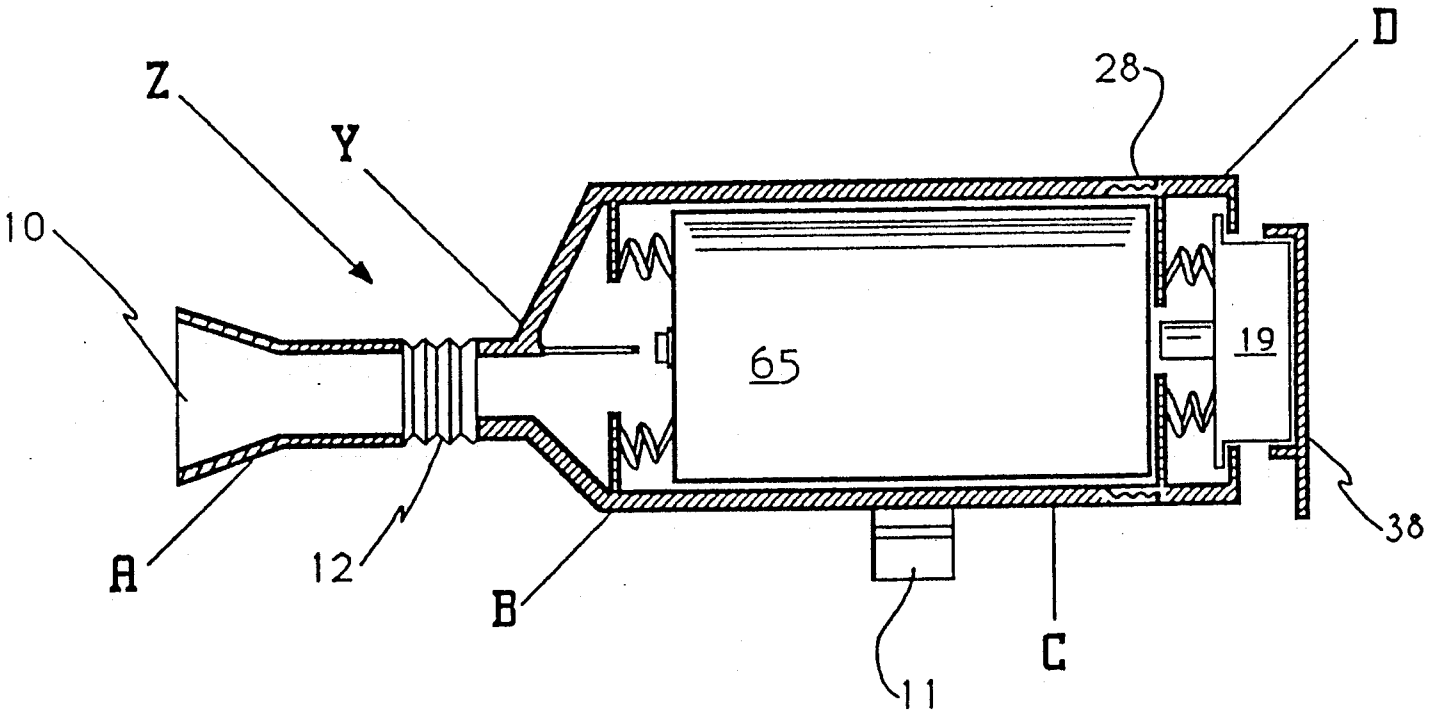
FIG. 2 is a cross sectional side view of the Comestible Cooling Device (Z) shown in FIG. 1; not all springs are shown in this figure in order to facilitate the clarity of the drawing.

FIGS. 1 and 2 show the housing (Y) containing a forwardly disposed portion (A) which has at it's front end at least one opening (10) and which is connected at it's back end to the frontal portion of housing part (B) with a flexible material (12) such as rubber, or thin, flexible, folded plastic (such as the kind used in common flexible plastic drinking straws), or the like, which will allow the frontal portion (A) to be moved directionally and hold itself in that position, thus providing a draft in the desired direction.

Figure 4:
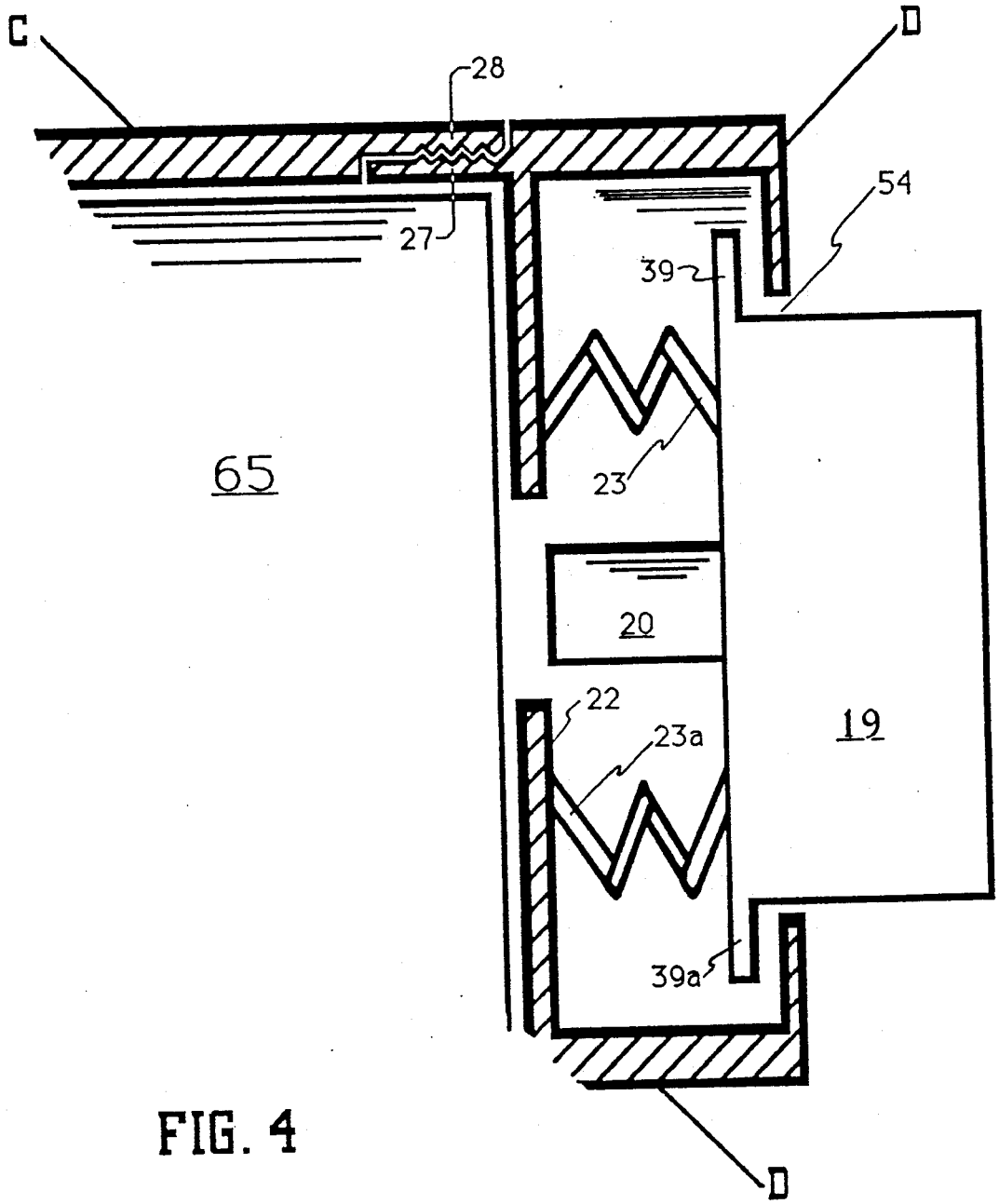
FIG. 4 is a fragmentary view of the back of FIG. 2, given in order to show that part of the Comestible Cooling Device (Z) in more detail.
Figure 4A:
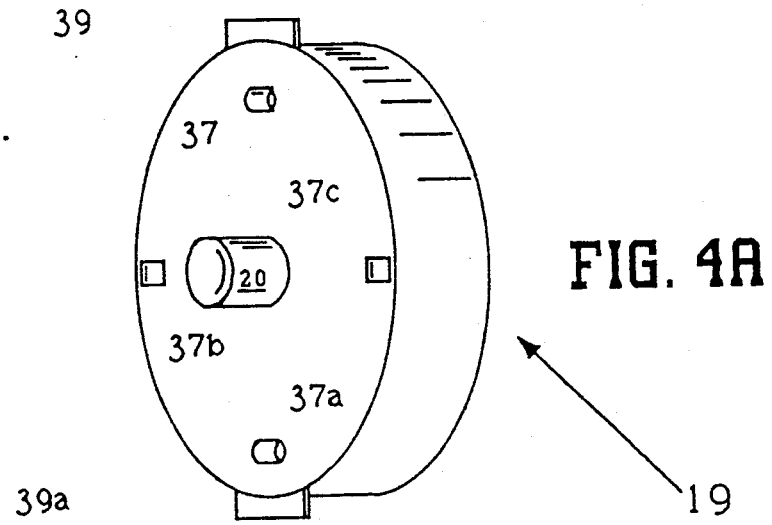
FIG. 4A is a perspective view of the "on" and "off" switch (19) shown in greater detail, without any springs attached thereto.

FIGS. 2 and 3 show housing part (D) enclosing the front end of a horizontally movable "on" and "off" switch (19) which extends through a circular opening (54) in the back wall of housing part (D) and which is held in the "off" position by the extended [at rest] position of commercially available springs (23, 23*a*, 23*b*, and 23*c*) that are connected to switch (19) by insertion into openings (37, 37*a*, 37*b*, and 37*c*), respectively, on switch (19), as shown in FIG. 4A. Protrusions (39 and 39*a*) located on switch (19) prevent the switch (19) from being pushed beyond housing part (D) by said springs. Other resilient material may be used in place of said springs, such as rubber, plastics, or the like. Springs (23, 23*a*, 23*b*, and 23*c*) are abutted on their opposite ends against the backward face of wall (22).

FIGS. 2 and 4 illustrate how a gas container (65) may be installed or removed from housing (Y) through an opening in the rear of housing part (C). To this extent the inner wall of housing part (C) is provided with threads at its rearward end (28) that cooperate with the external threads on tongue (27) of housing part (D). After insertion of gas container (65) into housing part (C), housing part (D) is inserted and "screwed into" housing part (C) [i.e.: part (D) is inserted into part (C) and rotated manually until a snug fit is achieved; or, similarly, upon the full cooperation of the internal and externals threads].

The gas canister (65) is held in place and in engagement with the front surface of wall (22) by having it's backward face being in pressured contact with wall (22) protruding from housing part (D).

FIGS. 2, 4, and 4A indicate the location of a column of sturdy material [i.e.: most types of solid metals or heavy plastic could be used for such a column] (20) extending horizontally forward from the center of the forward face of switch (19) and held in place on switch (20) by glue, adhesive, a commercially available screw, or other conventional securing means. Similarly, switch (19) and column (20) can be made as one piece. Hence, the movement of switch (19) horizontally inward or outward through opening (54) will cause column (20) to also move horizontally into or out of, respectively, a circular hole in the center of wall (22) of housing part (D). When switch (19) is moved horizontally into housing part (D), causing also column (20) to move forward through said hole in wall (22), the aforementioned tip of column (20) will be caused to come into physical contact with the backward face of gas container (65). When switch (19) is released, causing it to move horizontally out of housing part (D), column (20) will also move horizontally back through the hole in wall (22) causing the physical contact to be broken between column (20) and gas container (65).

A wall (63) similar to wall (22) is located towards the front of housing (Y), and attached to the backward face of wall (63) are a number [at least three] of commercially available springs (60), in a similar manner to springs (23-23c). A thin, inflexible extension/gas container opener (61) is located protruding in a backward direction from the inside of housing part (B), and may be attached to housing part (B) by conventional securing means or made as part of housing part (B). A ramification is also shown here as a switch extension (38) which can be placed over switch (19), which allows the user easier access to switch (19) and thus easier use of the Comestible Cooling Device.

The Comestible Cooling Device shown in FIGS. 1-5 operates as follows: gas container (65) is inserted into housing part (C) and subsequently held in place by housing part (D). Springs (60) thus have their back ends abutting against the front of container (65), holding container (65) so that the container (65) has it's back end abutted against the front face of wall (22). A draft of gas is provided when switch (19) is pushed forward into housing (Y) by the user, causing column (20) to move forward through housing (Y) and come into physical contact with the back face of container (65), causing container (65) to move forward through housing (Y) and contracting springs (60) and (23-23c). This causes extension (61) to penetrate the opening (62) of container (65), whereas the previously compressed gas will be released from container (65) and forced into air-passage (34) and further out opening (10). The draft is stopped when the user releases his pressure on switch (19), whereby springs (60) and (23-23c) expand from their previously contracted position, forcing container (65) backwards through housing (Y) and extension (61) to no longer penetrate opening (62).

FIGS. 6-20 show further ramifications, given so as to show the versatility of the Comestible Cooling Device, and some of the many forms it can take depending on the form of food or liquid holding device it is designed to be used with.

Figure 6:
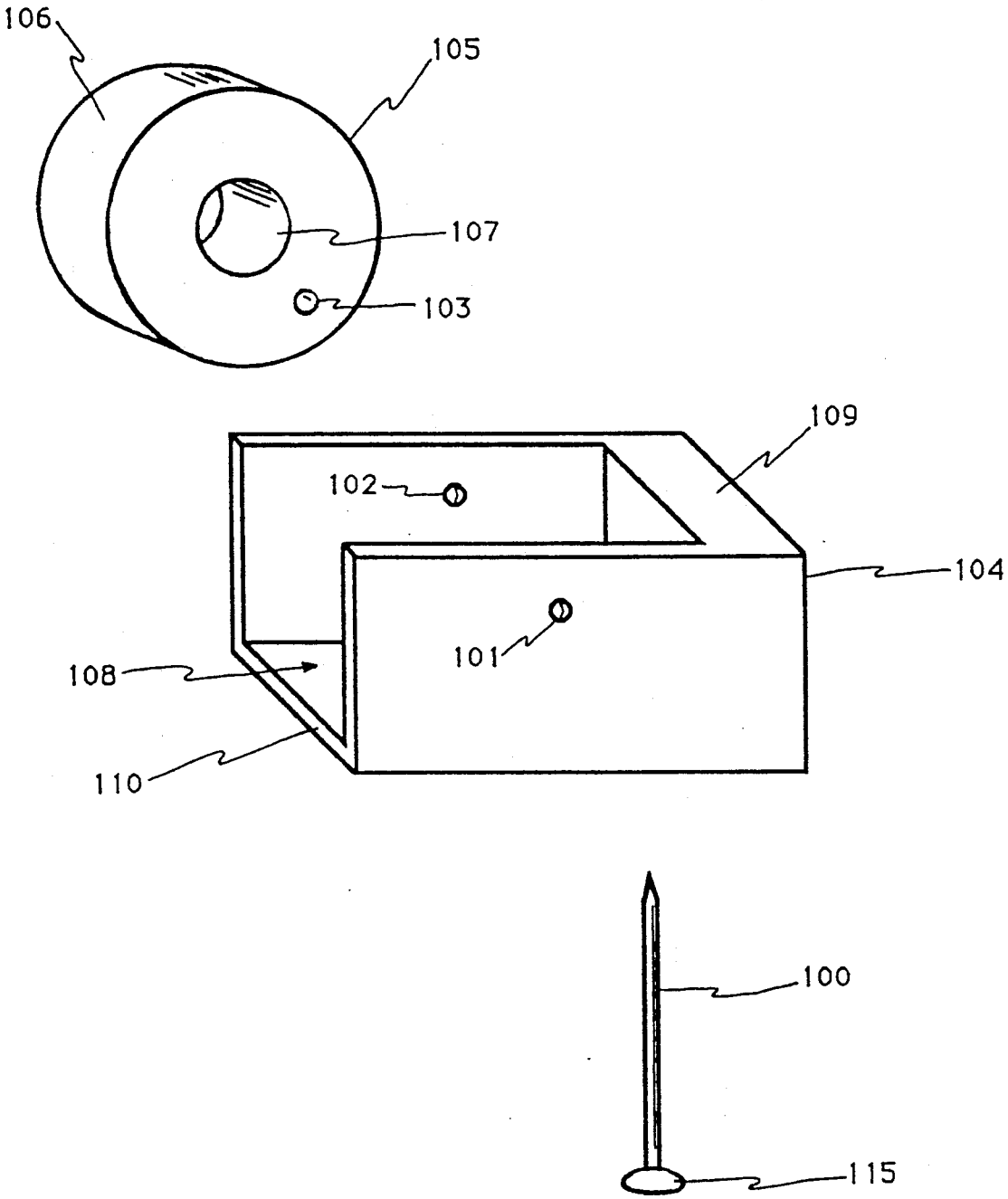
FIG. 6 is a perspective view of the parts of the slide-on holding device.

FIGS. 6-10 show a slide-on holding device (G) which may be used instead of clip-on unit (11) and attached to the underside of housing (Y) in a similar manner to clip-on unit (11). FIG. 6 shows how the slide-on holding device (G) is made of several parts: a rubber (or other suitably squashable material) wheel (105) with a hole in it's center (107) and a smaller hole (103) located midway between hole (107) and the outer surface (106) of wheel (105) which is suitable for insertion of fastener (100). Wheel holder (104) is made of rectangularly shaped plastic, or similar sturdy material. The wheel holder (104) has a rectangular shaped cavity (108) suitable for insertion of wheel (105). The wheel holder (104) also has two holes (101, 102) located on its side walls, which are suitable for insertion of fastener (100). Fastener (100) is used to hold wheel (105) in wheel holder (104), and can take the form of a screw, threaded fastener, nail, thin metal or plastic rod, or the like.

Figure 7:
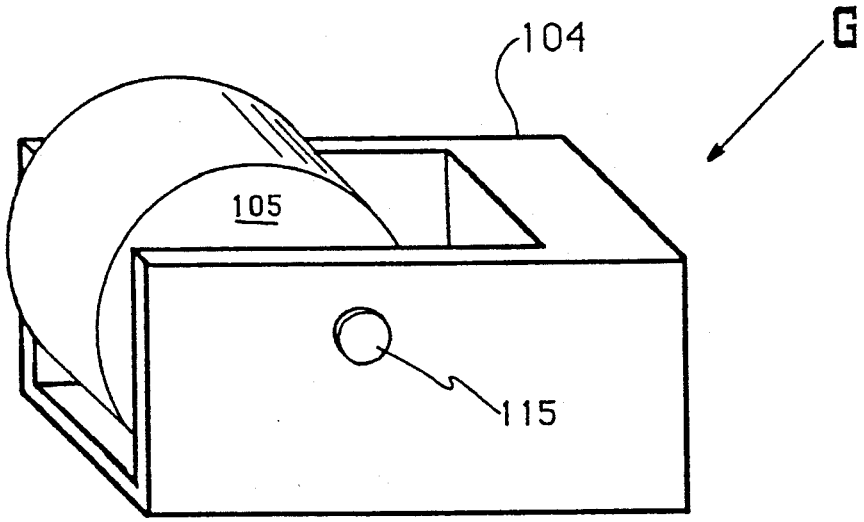
FIGS. 7 shows a perspective view of the slide-on holding device.

The wheel (105) is inserted into wheel holder (104) following which the fastener (100) is pushed through hole (101), then hole (103), and finally out hole (102). The fastener (100) is then made so that it will stay in this position by means such as a threaded nut, glue, bending the end of fastener (100), or the like. The complete slide-on holding device (G) is shown in FIG. 7.

Figure 8:
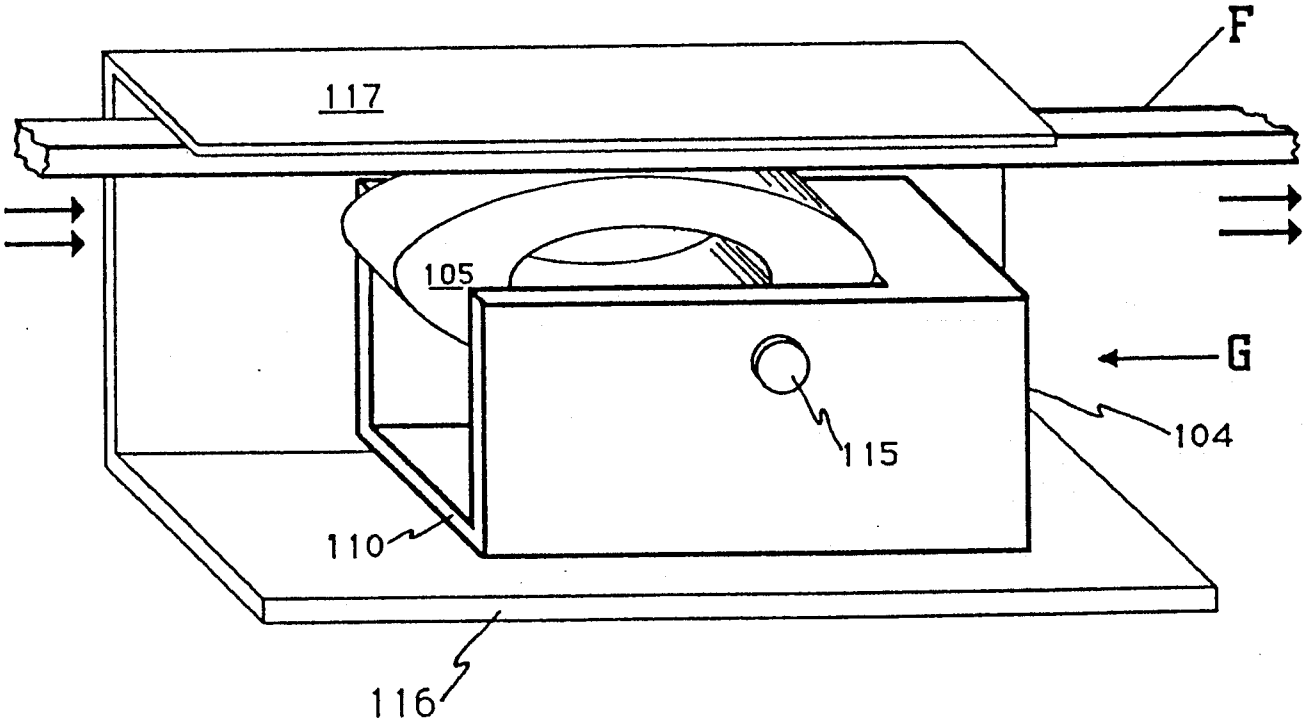
FIG. 8 shows a perspective view of the slide-on holding device (G) attached to the slide-on holding device holder (116) with the spoon (F) inserted therein, showing how the slide-on holding device (G) is meant to be used.

The slide-on holding device (G) is then mounted on a slide-on holding device holder (116) by securing the undersurface of the bottom of the wheel holder (110) top the top surface of the bottom of the slide-on holding device holder (116) with conventional securing means such as glue, a commercially available screw and nut, or the like, or the two pieces can be made as one piece, as shown in FIG. 8. The housing (Y) is then attached to the slide-on holding device (G) by securing the bottom of the former to the top side of the top part of the slide-on holding device holder (117) with conventional securing means such as glue, a commercially available screw and nut, or the like, or the two pieces can be made as one piece.

FIG. 8 also shows how the slide-on holding device (G) works: initially the wheel (105) rests with its outer surface (106) in contact with the bottom of the wheel holder (110). Spoon (F) is then inserted into the slide-on holding device holder (116) between the top of the slide-on holding device holder (117) and the wheel (105). Spoon (F) is then moved backwards manually in the direction of the arrows. The result of this action is that the undersurface of spoon (F) comes into contact with the outer surface of wheel (106), and through friction the spoon (F) "pulls" the wheel (105) backwards towards the back wall of the wheel holder (109). By ensuring that an insufficient space is left between the top of the slide-on holding device holder (117) and the wheel (105), the wheel (105) will be sequashed into an oval shape. [An insufficient space would be anything less than the thickness of the spoon (F).] This will create pressure between the wheel (105), the spoon (F), and the top of the slide-on holding device holder (117), resulting in the slide-on holding device holder (116) and the spoon (F) being securely clamped together, and thus the Comestible Cooling Device (Z) being secured to spoon (F). The slide-on holding device holder (116) and the spoon (F) can be unclamped by simply moving the spoon (F) forward through the slide-on holding device holder (116) against the direction of the arrows. This will facilitate the removal of spoon (F) from the slide-on holding device holder (116), since the wheel (105) will again be at rest with its outer surface (106) in contact with the bottom of the wheel holder (110).

FIG. 9 shows a ramification of the slide-on holding device holder (116) whereby a lengthwise groove (118) which is as wide as the width of spoon (F) is located on the underside of the top part of the slide-on holding device holder (117). This groove (118) would serve to better hold the spoon (F) in place when the slide-on holding device holder (116) and the spoon (F) are clamped together.

FIG. 10 also shows two other ramifications of the slide-on holding device (G), whereby two wheels (105) are utilized, and the wheels (105) will be perpendicular to the spoon (F) when the spoon (F) is secured to the slide-on holding device holder (116). With this ramification, spoon (F) is inserted sideways, in the direction of the arrows, which will create a securing of the spoon (F) to the slide-on holding device holder (116). In this ramification, fastener (100) is shown going through the center holes (107) of wheels (105). Because the spoon (F) is being inserted into the slide-on holding device holder (116) sideways, the desired securing of spoon (F) and the slide-on holding device holder (116) will still take place, as long as an insufficient space is left between the top of the slide-on holding device holder (117) and the wheel (105). [An insufficient space would be anything less than the thickness of the spoon (F).]

FIGS. 11-18 show another ramification, a snap-in holding device (H). The snap-in holding device (H) is made as one piece and consists simply of a three walled hollow rectangle made of a sturdy yet bendable material such as plastic or polymerized resin. Located on the inside of the snap-in holding device (H) are two long "teeth" running the length of the snap-in holding device (H) and pointing towards each other. Long "tooth" (120) is located on the underside of the top part of the snap-in holding device (121), and long "tooth" (122) is located on the upper surface of the bottom part of the snap-in holding device (123). A cavity (124) for the insertion on an item of cutlery [i.e.: spoon (F)] is formed inside the snap-in holding device (H). Housing (Y) would be attached to the snap-in holding device (H) by securing the bottom of the housing (Y) to the top surface of the top part of the snap-in holding device (121) with conventional securing means such as glue, a commercially available nut and bolt, a commercially available screw, tape, or the like. Spoon (F) can be slid into cavity (124) either by passing the tail end of spoon (F) through snap-in holding device (H) or by pushing the handle of spoon (F) into "teeth" (120, 122), which would cause the bottom part of the snap-in holding device (123) to bend downwards enough to allow the entry of the handle of spoon (F). Once the handle of spoon (F) has fully entered cavity (124), the bottom part of the snap-in holding device (H) would return to its original position, as shown in FIG. 13. Thus, the Comestible Cooling Device (Z) would be removably attached to spoon (F).

FIGS. 16, 17, and 18 show a snap-in holding (H) identical in all ways to the one shown in FIGS. 11, 12, and 13 except that it has two side walls and is void of the bottom part of the snap-in holding device (123). Also, "teeth" (120, 122) are now located on the inside of the side walls of the snap-in holding device (H) instead of on the top and bottom walls. This version of the snap-in holding device (H) works the same way as the snap-in holding device (H) described in FIGS. 11, 12, and 13, except that spoon (F) would be pushed up into the snap-in holding device (H), instead of pushed sideways into the snap-in holding device (H) as is done for FIGS. 11, 12, and 13.

Figure 14:
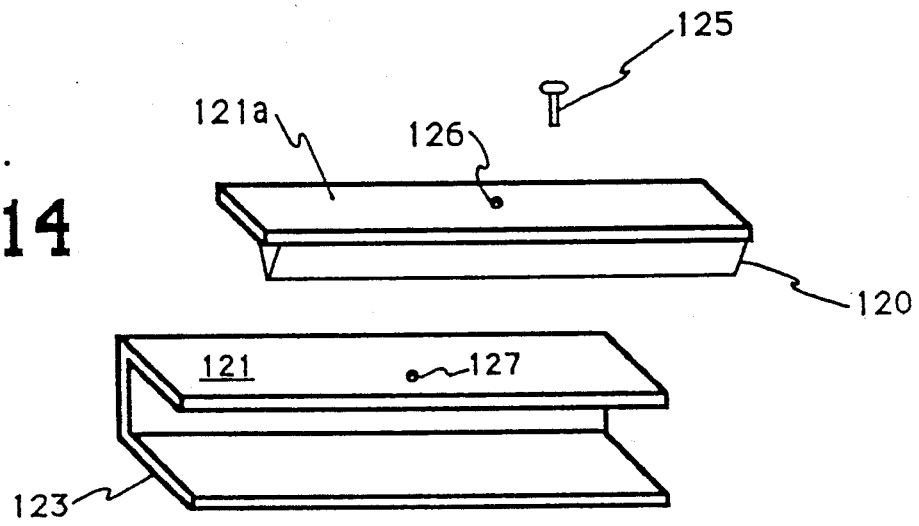
FIG. 14 shows a perspective view of the parts of a ramification of the snap-in holding device (H).
Figure 15:
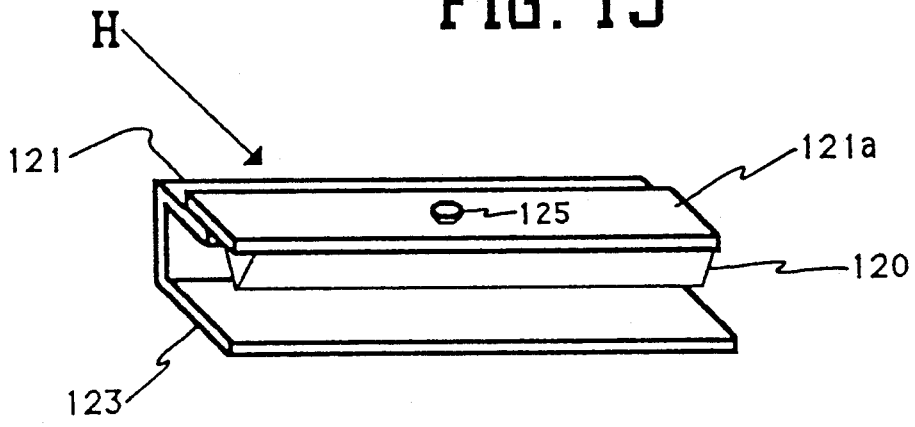
FIG. 15 shows a perspective view of a ramification of the snap-in holding device (H).

FIGS. 14 and 15 show the snap-in holding device (H) with a ramification which would allow it to better grip spoon (F) and thus provide better stability for the Comestible Cooling Device (Z) while it is attached to spoon (F). This version of the snap-in holding device (H) is similar to the snap-in holding device (H) shown in FIGS. 11, 12, and 13, except that it is made of two pieces. The top part of the snap-in holding device (121) is shorter and has a hole (127) suitable for insertion of fastener (125) located as shown in FIG. 14. Also shown is extension (121*a*) of the top part of the snap-in holding device (H), which has located on its undersurface long "tooth" (120) which extends downwards further than the same "tooth" shown in FIGS. 11, 12, and 13. Extension (121*a*) also has a hole (126) suitable for insertion of fastener (125) located as shown in FIG. 14. Extension (121*a*) is placed on top of top part (121) so that holes (126 and 127) are in congruence, following which the fastener (125) is inserted through both holes (126 and 127) and fastened so that it is irremovable and holds top part (121) and extension (121*a*) permanently together, as is shown in FIG. 15. Fastener (125) should be slightly thinner than holes (126 and 127) and fastened loosely enough so that sideways (horizontal) movement is allowed of extension (121*a*) along the top surface of top part (121). FIGS. 14 and 15 also show that "tooth" (122) is void from this version of the snap-in holding device (H).

The fastener (125) may be covered with a lubricant to facilitate any horizontal turning movement by the extension (121*a*) around the top part of the snap-in holding device (H). Said horizontal twisting movement of the top part (121) and extension (121*a*) would be of material assistance in facilitating a good "grip" between the snap-in holding device (H) and the food or liquid holding device [spoon (F)], since the snap-in holding device (H) would be able to conform to angled surfaces as well as straight ones, both of which are found on areas such as the handles of differently designed spoons. A thin layer of rubber or other material inclined to gripping or causing a better grip to be facilitated may be placed on the inner surface of the snap-in holding device (H) in order to facilitate a better grip between the snap-in holding device (H) and the food or liquid holding device [i.e.: spoon (F)].

This version of the snap-in holding device (H) can also be flipped upside-down so that the bottom part of the snap-in holding device (123) becomes the top of the snap-in holding device (H), which the housing (Y) would then be attached to as described above.

FIGS. 19 and 20 show a further ramification of the Comestible Cooling Device which would allow further aiming of the outflow of air.

FIG. 19 shows the housing (Y) having a transverse spider (131) located intermediate housing parts (B and C) therein. The gas container opener (61) is disposed in the passage (34), with one end of the gas container opener (61) being supported by the spider (131) and the opposite end being pointed towards the opening of the gas container (62). FIG. 19 shows the forward section of the housing, part (B), having at it's second end a tongue (133) defined therein. Housing part (C) is also shown to have at it's first end a recess (132) which extends and engages the tongue (133) of housing part (B). Housing parts (B) and (C) may be permanently secured to each other by conventional means such as glue, adhesive, or the like. The spider (131) is removably held in place within the confines of housing (Y) by having peripheral edge portions thereof engaged by circumferentially extending surfaces (132) and (133). The spider (131) can be made of a stronger material than the other parts of the Comestible Cooling Device, such as a strong metal, and may be made so that the spider (131) and the gas container opener (61) are one piece instead of two separate parts.

FIGS. 19 and 20 also show the shape of housing part (B) to be a short hollow tube, designed to extend the shape of housing part (C). Attached horizontally to the inner walls of housing part (B) and pointing downwards in parallel are thin rectangular fins (130), which can be made as part of housing part (B) or made separately and secured to housing part (B) in the above prescribed manner with conventional securing means such as glue or the like. To help accomplish the latter, housing part (B) can be made with grooves which would facilitate the insertion of the fins (130) in the correct position (horizontally and pointing down). Fins (130) would also help prevent any food or liquid from entering the Comestible Cooling Device (Z) through front opening (10).

Fins (130) would guide the air or gas flowing out of gas container (65) downwards out of opening (10).

While this invention has been described with reference to a particular embodiment thereof, it is apparent that many other forms and embodiments thereof will be obvious to those skilled in the art in view or the foregoing disclosure. Thus, the scope of the invention should be determined not by the embodiments illustrated, but by the appended claims and their legal equivalents.

OPERATION OF INVENTION

The use and operation of the present invention is very simple. The invention (Z), as described in the preferred embodiment above, is first mounted on a food or liquid holding container or utensil, here a spoon (F), by means of an attaching device, here a "slip in-slide on" clip on unit. The gas-filled container (65) is opened and a draft is provided by the user pushing the switch (19) forward into the housing (Y), in this case through the user pushing and holding the switch (19) with their finger, most appropriately their thumb if the spoon is held in a conventional way, while holding a spoon with the Comestible Cooling Device (Z) attached to it. When the user no longer desires a draft flowing onto the contents of the spoon, shown here as hot edible soup (57), they simply release any pressure that their thumb is putting on the switch (19) and let the switch (19) spring back to it's original "off" position.

The Comestible Cooling Device relies on the compression of air or other gases which are contained in a container and the force of that compression serving to force the air or gas out in the form of a draft, said container being mounted either on, within, or separately from the housing (Y) of the Comestible Cooling Device and with it's opening connected into the Comestible Cooling Device.

The embodiment shown in the drawings is made so that the housing (Y) is able to accommodate a thin container of compressed gas, with a switch on the housing and opening means upon which the activation thereof of said switch will cause the opening means to open said gas containing container. This opening of said container by the gas container opener (61) will cause said contained gas to be released into the housing and subsequently expelled, through it's own force of expulsion from said container, first into and then out of the Comestible Cooling Device and onto or around the food or liquid holding utensil or the like, as well as onto or around any food or liquid said utensil may be holding.

The direction of the discharged volume of air can be altered by manually moving the front housing part (A) into the desired position which will effectuate the directing of the discharged flow of air, as previously described.

The present invention can easily be modified and adapted to be used on a variety of utensils, containers, and other food and/or liquid holding devices, such as forks, coffee mugs, bowls, or any other conventional food or liquid holding device. The Comestible Cooling Device (Z) can be used whenever and wherever the user desires a stream of air to be directed onto their food or liquid, being especially easy and convenient to use.

SUMMARY, RAMIFICATIONS, AND SCOPE

Thus, the reader will see that the present invention, the Comestible Cooling Device (Z), provides a reliable, lightweight, efficient and easy-to-use device bringing such possible benefits as safety, protected health, more enjoyable meals, excitement, cleanliness, and others previously mentioned to the environment, the user, and anyone in close proximity to the user.

While the above description contains many specificities, these should not be construed as limitations on the scope of the invention, but rather as an exemplification of one preferred embodiment thereof. Many other variations are possible, for example:

1—Other switch means besides the one shown in the preferred embodiment can be used.

2—The front opening (10) may be made adjustable in order to facilitate different types and consistencies of different foods or liquids, and similarly may be of any radius or diameter.

3—The air or gas contained in the gas container may be refrigerated or otherwise be made to be cooler than atmospheric air. Or, air need not be used at all, and instead other gases such as freon, carbon dioxide, or the like, which will most likely be contained in a container, may be used in it's place.

4—The fins (130) shown in FIGS. 19 and 20 can be made to be adjustable so that the angle that they are pointing can be adjusted vertically or horizontally.

5—The Comestible Cooling Device (Z) can be attached to whichever means will be used to secure it to a food or liquid holding device, so that there is flexibility between the Comestible Cooling Device (Z) and said means of attachment. In other words, the Comestible Cooling Device (Z) would have the ability to pivot horizontally or move vertically on the means used to attach it to a spoon or other food or liquid holding device [i.e.: the clip-on attaching unit (11)].

6—The air-outflow opening (10) shown in FIGS. 1-5 can be made to have "fins" as shown in FIGS. 19 and 20.

7—The switch can be located elsewhere on the device, such as the top or side of the Comestible Cooling Device (Z), or not on the device at all and instead located on a remote control, on the cutlery, or similar place.

8—The switch can be made to have the ability to be temporarily locked in either the "on" position or the "off" position through the use of locking means.

9—The Comestible Cooling Device (Z) may be attached either temporarily or permanently onto the utensil, container, etc., and may be held in place there by any conventional securing means [including means capable of directional adjustment], such as a snap-on device, magnets, slip-in device, lock-on device, tape, glue, adhesive, slide-on device, twist-on device, screw-on device, clamp, or the like.

10—The Comestible Cooling Device (Z) can be made of any type of material, including metals, plastics, rubber, or any other suitable material.

11—The Comestible Cooling Device (Z) can be made to utilize other regulating means to regulate the outflow of air, such as an adjustable air-outflow opening.

12—The Comestible Cooling Device (Z) can be used with any food or liquid holding device, utensil, or container.

13—The housing of the Comestible Cooling Device (Z) may be in any shape, such as rectangular, square, or the like.

14—A screen or suitable mesh-like material may be used to cover the opening (10) at the front of the Comestible Cooling Device (Z).

15—Springs (23-23c) need not be included in the invention if desired, as the present invention will still work without them.

16—There may be more than one front opening (10).

17—The front housing part (A) can be immovably attached to housing part (B) so that there would exist no capability for flexibility [i.e.: no flexible material at (12)] at the connection point between parts (A) and (B).

18—The Comestible Cooling Device (Z) can be made to be free standing.

19—The Comestible Cooling Device (Z) can be colored in any way or similarly designed for a pleasing visual experience.

20—More than one gas canister can be used inside the Comestible Cooling Device (Z).

21—The switch (19) can be made hollow and "squeezable" in order to facilitate the insertion of switch (19) into housing part (D) after part (D) has been manufactured; this can then be easily done by squeezing the sides of the switch, inserting said switch into part (D), and then "unsqueezing", or letting the switch reform into it's original shape.

22—Similarly, the back wall of housing part (D) can have notches included at the outer rim of circular hole (54) in part (D) which could be the same size as protrusions (39 and 39*a*) on switch (19). Thus switch (19) can be inserted into part (D) by lining up protrusions (39 and 39*a*) at said notches and pushing switch (19) into part (D), and then turning the switch (19) clockwise or counterclockwise so that the protrusions are no longer lined up with said notches.

23—The Comestible Cooling Device (Z) can be made so that the means of attachment for attaching the Comestible Cooling Device (Z) to a food or liquid holding device [i.e.: clip-on attaching unit (11)] is movable lengthwise along the bottom of the Comestible Cooling Device (Z). In other words, the attaching means could slide along the underside of the Comestible Cooling Device (Z).

24—Cooling coils, refrigeration coils, or similar cooling means may be included in the inside of housing (Y), such that the air exiting the gas container will come into contact with the cooling means resulting in said air becoming cooler than it was before entering housing (Y), and hence will be cooler than the atmospheric air upon discharge from housing (Y) through front opening (10).

25—A stabilizer may be attached to the housing (Y) in order to keep the Comestible Cooling Device (Z) steady and unmoving when it is attached to a food or liquid holding device (as described in the description and shown in FIG. 1). The stabilizer may extend lengthwise so that the front of the stabilizer which actually rests on the handle of the spoon, fork, etc. reaches past the forward end of the handle of the spoon, fork, etc. to the back end of the bowl of the spoon, prongs of the fork, etc. In this way the stabilizer will prevent the Comestible Cooling Device (Z) from moving forward on the food or liquid holding device which the Comestible Cooling Device (Z) is mounted on.

26—The Comestible Cooling Device (Z)'s shape may be modified in relation to the food or liquid holding device it is designed to be used with; i.e.: the housing (Y) may be designed in a "V" shape in order to fit more compactly on a coffee mug.

27—The Comestible Cooling Device (Z) can have a switch extension attached to switch (19), as shown in FIG. 6 as switch extension (38), in order to facilitate easier access to switch (19) by the user.

28—The Comestible Cooling Device (Z) can be otherwise made so that space may be saved lengthwise, such as by designing the housing so that the gas container (65) is adjacent to, above, below, etc. the rest of the Comestible Cooling Device (Z).

29—The snap-in holding device (H) shown in FIGS. 16, 17, and 18 can be made with the ramification showed in FIGS. 14 and 15 so that the side walls are movable horizontally in relation to the top part of the snap-in holding device (121) in order to facilitate a better grip between the snap-in holding device (H) and the spoon (F).

30—Gas container (65) can be located outside of the housing (Y), for example it can be attached to the underside of the attaching means [i.e.: the snap-in holding device (H)] and have a hollow tube connecting the opening of the gas container (62) with the housing (Y).

31—No gas container need be used at all; instead a finger operated "bellows" can be inserted in the housing (Y) in the same manner as the gas container (65), and the switch (19) can be used to pump the bellows so that air is forcefully expelled from the opening (10) of the Comestible Cooling Device (Z).

32—The ramification shown in FIGS. 19 and 20 can also have vertical fins either in addition to or instead of horizontal fins (30).

33—The snap-in holding device (G) shown in FIGS. 11-18 need not have teeth (120 and 122) and may simply have thin rubber or the like lining the inside walls of the snap-in holding device (G).

Accordingly, the scope of the invention should not be solely determined by the embodiment illustrated, but by the appended claims and their legal equivalents.

I claim:

1. A combination eating utensil and cooling device comprising:
   - an eating utensil having an elongated handle portion and a food-engaging portion;
   - means for providing a draft of released compressed gas contained in a housing;
   - and attaching means for attaching said housing to said elongated handle portion, whereby said draft is generated from said housing onto said food-engaging portion of said eating utensil.

2. A cooling device for food and liquid as defined in claim 1
   - wherein a flexible material is incorporated into a limited portion of an outer wall of said housing, whereby a draft emanating from said cooling device may be directed in a more accurate direction.

3. A cooling device for food and liquid as defined in claim 1
   - wherein fins are incorporated into a limited portion of said housing, whereby a draft emanating from said cooling device may be directed in a more accurate direction.

4. A cooling device for food and liquid as defined in claim 1 further including switch means whereby said cooling means may be selectively actuated.

5. A cooling device for food and liquid as defined in claim 1 further including resilient switch means, whereby said cooling means may be selectively actuated.

6. A cooling device for food and liquid as defined in claim 1 further including locking switch means, whereby said cooling means may be selectively actuated.

7. A cooling device for food and liquid as defined in claim 1 further including stabilizing means attached to said housing, whereby said cooling device for food and liquid may be held steadily on a food or liquid holding device.

8. A cooling device for food and liquid as defined in claim 1 whereby said attaching means consists of temporary securing means for removably securing said cooling device to a food or liquid holding device, whereby a draft may be generated from said cooling device onto or around the food or liquid holding device as well as any food or liquid held by the food or liquid holding device.

9. A cooling device for food and liquid as defined in claim 8 wherein said securing means is comprising of a slide-on clip.

10. A cooling device for food and liquid as defined in claim 8 wherein said securing means is comprised of a slide-on holding device.

11. A cooling device for food and liquid as defined in claim 8 wherein said securing means is comprising of a snap-in holding device.

12. A cooling device for food and liquid as defined in claim 1 whereby said attaching means consists of permanent securing means for removably securing said cooling device to a food or liquid holding device, whereby a draft may be generated from said cooling device onto or around the food or liquid holding device as well as any food or liquid held by the food or liquid holding device.

13. A cooling device for food and liquid as defined in claim 1, comprising:

(a) an elongate housing that has at least one first open end;

(b) a cavity adapted to receive a gas containing container within said housing which facilitates said container in a fashion which assures the opening for the exit of said gas from said container to be within said housing after insertion of said container;

(c) opening means which upon activation will cause said gas contained within said container to escape from said container, thereby causing said gas to flow into said housing to be subsequently expelled from said housing by way of a frontal open end;

(d) a closure cap for closing said cavity, whereby said container may be removably held in place within said cavity.

14. A cooling device for food and liquid as defined in claim 1, comprising:

(a) an elongate housing that has at least one first open end;

(b) a cavity adapted to receive gas from a gas container not housed in the housing;

(c) opening means which upon activation will cause said gas contained within said container to escape from said container, thereby causing said gas to flow into said housing to be subsequently expelled from said housing by way of a frontal open end.

15. A cooling device for food and liquid as defined in claim 13 further including adjusting means for varying the open area of the opening at the front of said housing, whereby the effective area of said open area of the opening at the front of said housing may be changed.

16. A cooling device for food and liquid as defined in claim 14 further including adjusting means for varying the open area of the opening at the front of said housing, whereby the effective area of said open area of the opening at the front of said housing may be changed.

* * * * *